US008413740B2

(12) United States Patent
Rodenhouse

(10) Patent No.: US 8,413,740 B2
(45) Date of Patent: Apr. 9, 2013

(54) FASTENER GUN WASHER ASSEMBLY HOLDING DEVICE AND METHOD OF USE

(75) Inventor: Robert H. Rodenhouse, Grand Rapids, MI (US)

(73) Assignee: Rodenhouse, Inc., Grand Rapids, MI (US)

( * ) Notice: Subject to any disclaimer, the term of this patent is extended or adjusted under 35 U.S.C. 154(b) by 125 days.

(21) Appl. No.: 12/507,851

(22) Filed: Jul. 23, 2009

(65) Prior Publication Data

US 2010/0019014 A1 Jan. 28, 2010

Related U.S. Application Data

(60) Provisional application No. 61/083,061, filed on Jul. 23, 2008.

(51) Int. Cl.

| | |
|---|---|
| ***B25B 13/46*** | (2006.01) |
| ***E21B 3/00*** | (2006.01) |
| ***E21B 17/22*** | (2006.01) |
| ***E21B 19/16*** | (2006.01) |
| ***E21B 19/18*** | (2006.01) |
| ***B31B 1/68*** | (2006.01) |

(52) U.S. Cl. ..... 173/29; 227/64; 173/213

(58) Field of Classification Search ..... 173/29; 227/171, 64–76, 213; 81/57.14; 411/368, 411/442, 43

See application file for complete search history.

(56) References Cited

U.S. PATENT DOCUMENTS

| | | | | | |
|---|---|---|---|---|---|
| 221,694 | A | * | 11/1879 | Mulholland | 124/16 |
| 931,221 | A | * | 8/1909 | Rogers | 473/511 |
| 2,925,602 | A | * | 2/1960 | Kopf et al. | 227/8 |
| 3,060,440 | A | * | 10/1962 | De Caro et al. | 227/147 |
| 3,232,285 | A | * | 2/1966 | Rasner | 124/21 |
| 3,602,419 | A | * | 8/1971 | Doberne et al. | 227/147 |
| 3,638,892 | A | * | 2/1972 | Boye et al. | 248/300 |
| 3,734,377 | A | * | 5/1973 | Munn | 227/120 |
| 3,779,105 | A | * | 12/1973 | Triplett et al. | 81/124.5 |
| 3,827,509 | A | * | 8/1974 | Larson | 173/128 |
| 3,906,819 | A | * | 9/1975 | Curtis | 81/475 |
| 4,060,089 | A | * | 11/1977 | Noiles | 606/220 |
| 4,082,475 | A | * | 4/1978 | Kuder | 408/125 |
| 4,094,490 | A | * | 6/1978 | Einhorn | 248/489 |
| 4,214,490 | A | * | 7/1980 | Chizek | 81/9.22 |

(Continued)

OTHER PUBLICATIONS

Statement by inventor Robert H. Rodenhouse, Aug. 4, 2010.

(Continued)

*Primary Examiner* — Robert Long

(74) *Attorney, Agent, or Firm* — Gardner, Linn, Burkhart & Flory, LLP

(57) ABSTRACT

A washer holding device for temporarily retaining nonmagnetic washers being applied to a building material surface with a fastener gun comprises an arm for affixing the washer holding device to a fastener gun and a washer receptacle joined to the arm. The washer receptacle includes a contacting end, a washer receiving cavity, and a central aperture, with the contacting end defining a distal end of the washer holding device and the cavity sized to receive a nonmagnetic washer such that the washer is temporarily retained within the cavity via a friction fit. An embodiment may include a shoulder, such as an annular flange, recessed from the contacting end, with the shoulder adapted to contact the surface of a deformable building material to limit the depression of the washer receptacle into the building material. The arm may be of various configurations for use with different style fastener guns.

17 Claims, 5 Drawing Sheets

U.S. PATENT DOCUMENTS

| | | | | |
|---|---|---|---|---|
| 4,538,483 | A * | 9/1985 | Batten | 81/56 |
| 4,541,402 | A * | 9/1985 | Winters | 124/27 |
| 4,684,050 | A * | 8/1987 | Masas | 227/10 |
| 4,703,883 | A * | 11/1987 | Losada | 227/9 |
| 4,708,552 | A * | 11/1987 | Bustos et al. | 411/80.1 |
| 4,809,568 | A * | 3/1989 | DeCaro | 81/57.37 |
| 4,974,685 | A * | 12/1990 | Coffenberry | 173/138 |
| 5,016,802 | A * | 5/1991 | Haytayan | 227/11 |
| 5,199,506 | A * | 4/1993 | Dewey et al. | 173/104 |
| 5,316,422 | A * | 5/1994 | Coffman | 411/107 |
| 5,378,102 | A * | 1/1995 | Mossman | 411/531 |
| 5,443,344 | A * | 8/1995 | Underwood, Jr. | 411/43 |
| 5,458,608 | A * | 10/1995 | Wortrich | 606/139 |
| 5,484,094 | A * | 1/1996 | Gupta | 227/8 |
| 5,517,883 | A * | 5/1996 | Goldi et al. | 81/57.37 |
| 5,673,839 | A * | 10/1997 | Howard et al. | 227/119 |
| 5,772,381 | A * | 6/1998 | Olvera et al. | 411/533 |
| 5,875,951 | A * | 3/1999 | Ingle et al. | 227/147 |
| 5,943,926 | A * | 8/1999 | Habermehl | 81/434 |
| 6,079,398 | A * | 6/2000 | Grimm | 124/16 |
| 6,145,723 | A * | 11/2000 | Gupta | 227/8 |
| 6,145,725 | A * | 11/2000 | Omli | 227/18 |
| 6,213,371 | B1 * | 4/2001 | Cabrera | 227/8 |
| 6,431,517 | B1 * | 8/2002 | Chapman | 249/93 |
| 6,598,775 | B1 * | 7/2003 | Chen | 227/113 |
| 6,742,509 | B2 * | 6/2004 | Hunter et al. | 124/17 |
| 6,755,597 | B2 * | 6/2004 | Bergner et al. | 409/178 |
| 6,779,700 | B2 * | 8/2004 | Bruins et al. | 227/136 |
| 6,783,048 | B2 * | 8/2004 | Powell | 227/113 |
| 6,908,022 | B2 * | 6/2005 | Schmitz | 227/119 |
| 6,968,945 | B2 * | 11/2005 | Bruins et al. | 206/338 |
| 7,044,031 | B1 * | 5/2006 | Mullen | 81/121.1 |
| 7,093,338 | B2 * | 8/2006 | Powers et al. | 29/525.01 |
| 7,096,972 | B2 * | 8/2006 | Orozco, Jr. | 173/171 |
| 7,232,050 | B2 * | 6/2007 | Omli | 227/31 |
| 7,344,058 | B2 * | 3/2008 | Bruins et al. | 227/18 |
| 7,387,173 | B2 * | 6/2008 | Jinnings et al. | 173/184 |
| 7,448,371 | B2 * | 11/2008 | Sapir | 124/16 |
| 7,513,404 | B2 * | 4/2009 | Shkolnikov et al. | 227/8 |
| 7,670,362 | B2 * | 3/2010 | Zergiebel | 606/311 |
| 7,721,627 | B2 * | 5/2010 | Basham et al. | 81/57.14 |
| 7,758,612 | B2 * | 7/2010 | Shipp | 606/219 |
| 7,918,879 | B2 * | 4/2011 | Yeung et al. | 606/300 |
| 8,047,100 | B2 * | 11/2011 | King | 81/57.37 |
| 8,056,785 | B2 * | 11/2011 | Gosis et al. | 227/19 |
| 8,061,000 | B2 * | 11/2011 | Santamarina et al. | 29/275 |
| 2003/0035702 | A1 * | 2/2003 | Lin | 411/442 |
| 2003/0102350 | A1 * | 6/2003 | Liu et al. | 227/18 |
| 2004/0194422 | A1 * | 10/2004 | Rodenhouse | 52/741.1 |
| 2009/0008116 | A1 * | 1/2009 | Jinnings et al. | 173/195 |
| 2009/0084567 | A1 * | 4/2009 | Basham et al. | 173/29 |

OTHER PUBLICATIONS

Grid-Mate PB Mechanical Fasteners, 1999 Tool Works, Inc.

Wind-Lock catalog excerpt disclosing fastening tool system available prior to Jul. 23, 2007.

Wind-Lock catalog excerpt, disclosing fastening tool equipment available prior to Jul. 23, 2007.

Wind-Lock Catalog excerpt dated 2001.

Wind-lock catalog excerpt dated 2003.

Stuccofast brochure disclosing fastening system available prior to Jul. 23, 2007.

Performance and Selector Guide 2002, 2001 Illinois Tool Works Inc.

* cited by examiner

FASTENER GUN WASHER ASSEMBLY HOLDING DEVICE AND METHOD OF USE

CROSS REFERENCE TO RELATED APPLICATION

The present application claims the benefit of U.S. provisional patent application Ser. No. 61/083,061 filed Jul. 23, 2008, which is hereby incorporated herein by reference in its entirety.

BACKGROUND AND FIELD OF THE INVENTION

The present invention is directed to a fastener gun washer assembly holding device and method of use.

Fasteners and nonmagnetic washers are used to secure exterior wall systems, such as wall systems utilizing three-coat stucco, one-coat systems, polymer modified (PM) systems over rigid foam, and polymer based (PB) systems (EIFS) over expanded polystyrene (EPS foam), with the washers being used in securing a wide range of building materials, including soft foam, rigid foam, or hard surfaces. Different materials and textures may also be installed as components to exterior wall systems, such as commercial or house building wrap, drainage fabric, felt paper, stucco wire-lath, diamond mesh, or foam insulation panels.

The fastener and washers are affixed using fastener guns, such as electric, pneumatic, or gas driven guns. Conventional prior art fastener guns used with collated fasteners include a safety stem or extension piece extending from the gun that prevent the fastener gun from operating unless the safety stem is pressed against a surface. Compression of the safety stem against a surface triggers indexing of the collated fastener, such as a screw, for the next shot and enables the fastener to be driven into the surface until the driver bit automatically releases the screw at the exact depth. When using a fastener gun employing collated fasteners, the installer must manually hold the nonmagnetic washer centered in position in front of the safety stem, thereby requiring the use of two hands to perform the operation and increasing the risk of injury.

In the case of fastener guns that do not employ collated fasteners, the fastener and washers may be supplied to a building site in either a pre-staked or pre-assembled condition, or must be manually assembled on site by the installers. The difficulty in field assembling the combination of a washer and a fastener, such as a screw, cause them to be either dropped or spilled, such as from scaffolding, onto the ground, creating a hazardous work area. The alternative pre-assembled fasteners are expensive and the numerous range of fastener sizes and washer combinations are difficult to inventory, The washer and fastener assemblies are difficult to handle especially in colder climates when installers wear gloves.

SUMMARY OF THE INVENTION

The present invention provides a fastener gun washer assembly holding device and method of use enabling convenient retention of nonmagnetic washers such that the washers may be accurately and safely secured to a building material surface by a fastener.

According to an aspect of the present invention, a washer holding device for temporarily retaining nonmagnetic washers being applied to a building material surface with a fastener gun comprises an arm having a first end and a second end, with the arm being selectively and removably affixable to a fastener gun and having a washer receptacle joined to the first end of the ann. The receptacle including a building material surface contacting end, a washer receiving cavity, and a central aperture, with the contacting end defining a distal end of the washer holding device. The cavity being sized to receive a nonmagnetic washer such that the nonmagnetic washer is temporarily retained within the cavity via a friction fit connection with the cavity.

In particular embodiments the washer receptacle may further include an external shoulder recessed away from the contacting end, with the shoulder adapted to contact a building material surface and limit the depression of the washer receptacle into the building material surface when the washer holding device is used to apply a nonmagnetic washer to a deformable building material. The shoulder may optionally be formed as a flange at least partially surrounding the washer receptacle, or comprise an annular flange disposed about the washer receptacle, and may be recessed from the contacting end a distance at least as thick as the nonmagnetic washer to be applied to the building material surface such that the nonmagnetic washer is recessed beneath the building material surface. The arm may be of various configurations for use with different style fastener guns, and may be straight or angled, and may include mounting apertures or a quick connect coupling.

According to another aspect of the present invention a washer holding device and fastener gun assembly for applying nonmagnetic washers to a building material surface using fasteners comprises a fastener gun for driving fasteners and a washer holding device for temporarily retaining a nonmagnetic washer that is to be applied to a building material surface. The washer holding device comprises an arm for selectively and removably affixable to the fastener gun and a washer receptacle mounted to the first end of the arm. The washer receptacle includes a building material surface contacting end, a washer receiving cavity, and a central aperture, with the contacting end defining a distal end of the washer holding device, and with the cavity being sized to receive a nonmagnetic washer such that the nonmagnetic washer is temporarily retained within the cavity via a friction fit connection with the cavity. The fastener gun is activated to enable a fastener to be applied by the fastener gun when the contacting end of the washer holding device is depressed against a building material surface with a fastener being driven through the central aperture to secure the nonmagnetic washer to the building material surface.

In particular embodiments the washer receptacle further includes a flange at least partially surrounding the washer receptacle, with the flange being recessed away from the contacting end such that the flange is able to contact a building material surface and limit the depression of the washer receptacle into the building material surface when the washer holding device is used to apply a nonmagnetic washer to a deformable building material. The flange may be formed as an annular flange extending generally perpendicularly outwards from the washer receptacle relative to the axis of application of a fastener through the central aperture, and may be recessed from the contacting end a distance at least as thick as the nonmagnetic washer to be applied to the building material surface such that the nonmagnetic washer is recessed beneath the building material surface.

According to another aspect of the invention, a method of mounting a construction material to a building using a washer holding device and fastener gun assembly comprises the steps of providing a fastener gun having a washer holding device affixed thereto, with the washer holding device comprising an arm affixed to the fastener gun and a washer receptacle mounted to the arm and including a building material surface contacting end, a washer receiving cavity, and a central aperture. The method further includes the steps of placing a nonmagnetic washer into the cavity with the washer being retained in the cavity via a friction fit connection with the cavity, positioning the contacting end of the washer holding device against a building material surface to enable activation of the fastener gun, and activating the fastener gun whereby a fastener is driven through the central aperture and through the washer to secure the washer to the building material surface.

In particular embodiments of the method, the washer holding device further comprises a flange at least partially surrounding the washer receptacle with the flange being recessed away from the contacting end, and the method further includes limiting the depression of the washer receptacle into a deformable building material by the flange contacting the building material surface during the step of activating the fastener gun. The flange may be recessed from the contacting end a distance at least as thick as the nonmagnetic washer to be applied to the building material surface such that the step of limiting the depression of the washer receptacle into a deformable building material surface includes recessing the nonmagnetic washer beneath the building material surface.

The washer holding device and assembly including a fastener gun, along with the method of use, provide an accurate, convenient and safe way to apply nonmagnetic washers to a building surface. An installer does not need to place a hand in front of a fastener gun to hold a washer in place, making the operation safer and freeing up a hand for making the operation more efficient. The washer holding device also holds the washer in precisely in place prior to installation such that it may be more accurately and repeatedly installed. Embodiments including a shoulder, such as an annular flange extending about the receptacle and recessed from the contacting end provide a washer holding device that is well suited for use with deformable building materials such as foam to limit the penetration of the washer holding device into the building material and control the depth of installation of the washer.

These and other objects, advantages, purposes and features of this invention will become apparent upon review of the following specification in conjunction with the drawings.

DESCRIPTION OF THE PREFERRED EMBODIMENTS

Figures 1, 2:
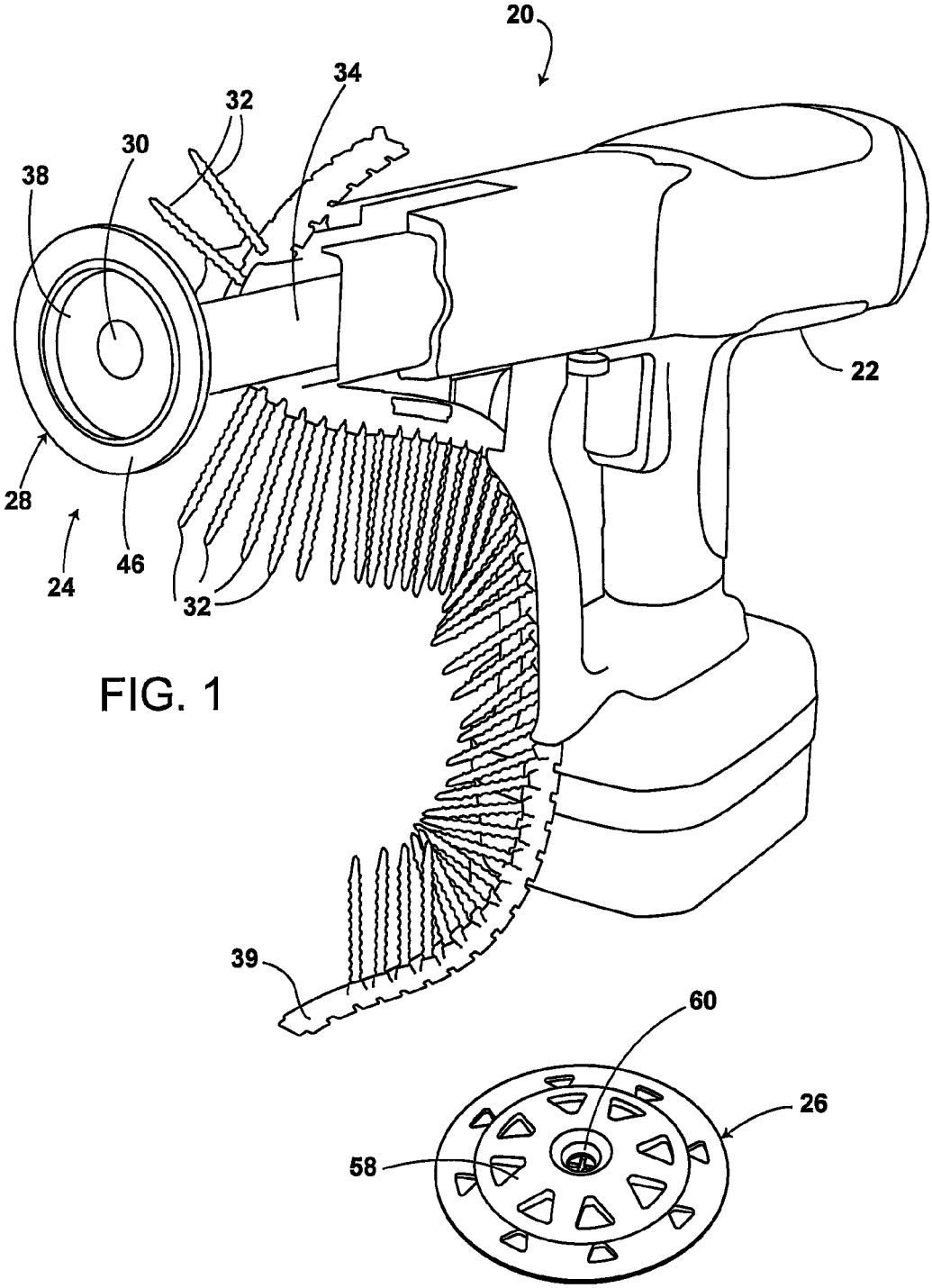
FIG. 1 is a perspective view of a washer holding device and fastener gun assembly in accordance with the present invention.
FIG. 2 is a perspective view of a nonmagnetic washer for use with the washer holding device of the present invention.

The present invention will now be described with reference to the accompanying figures, wherein the numbered elements in the following written description correspond to like-numbered elements in the figures. A fastener gun assembly 20 is illustrated in FIG. 1 that includes a fastener gun 22 to which is mounted a washer holding device 24 for temporarily retaining nonmagnetic washers, such as plastic washer 26 (FIG. 2), that are being applied to a building material surface using fastener gun 22. Washer holding device 24 replaces the standard safety stem nose piece of fastener gun 22 and includes a washer receptacle 28 having an aperture 30, with receptacle 28 adapted to receive and temporarily hold washer 26 hands-free of the operator such that the operator is able to operate gun 22 to drive a fastener 32 through the aperture 22 into washer 26 to mount washer 26 to the building surface while keeping his or her hands free of the driven fastener 32.

Figure 5:
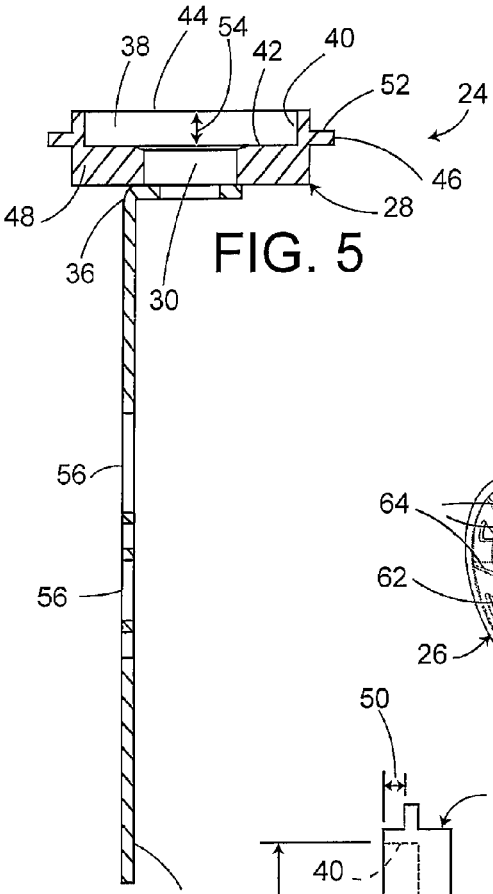
FIG. 5 is a cross-sectional view of the washer holding device of FIG. 3.
Figure 3:
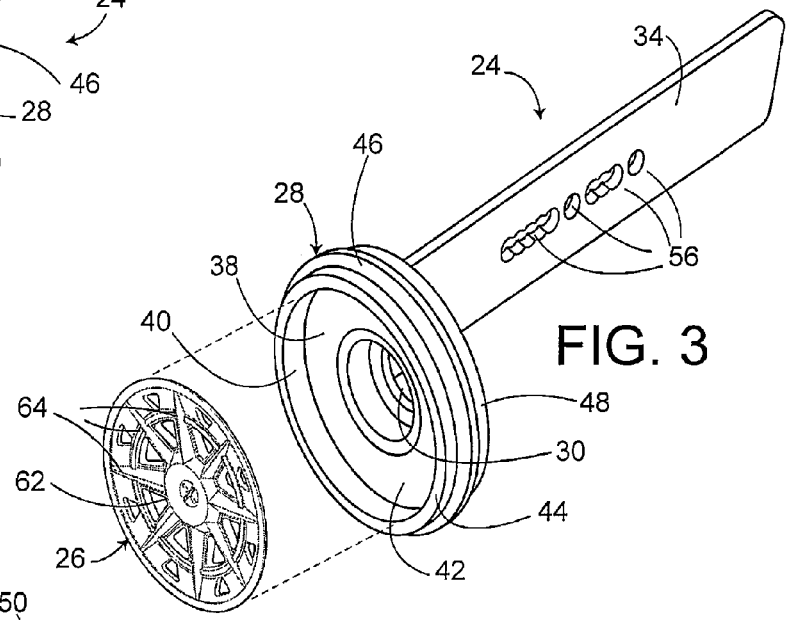
FIG. 3 is an exploded perspective view of the washer holding device of FIG. 1 in accordance with the present invention removed from the fastener gun and showing a washer prior to assembly into the cavity of the washer holding device.
Figure 4:
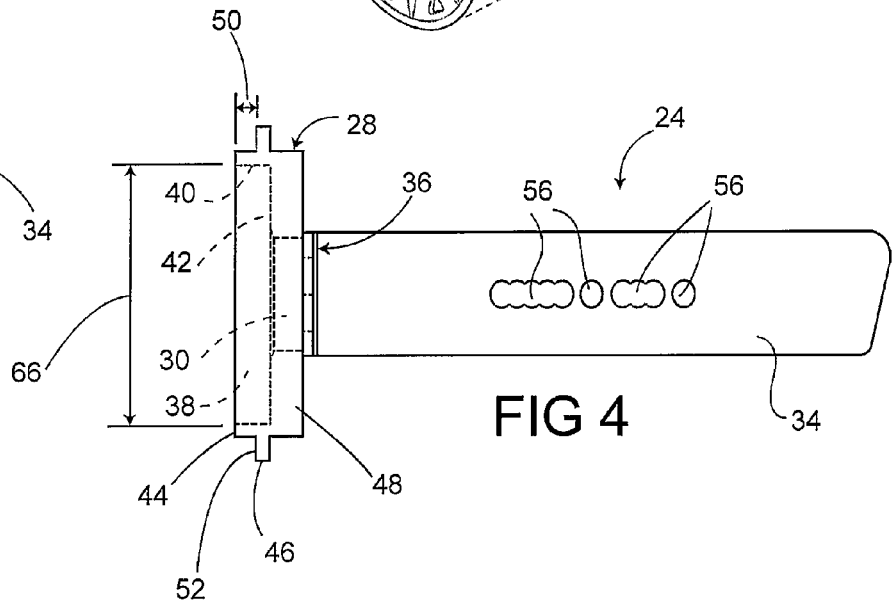
FIG. 4 is a side elevation view of the washer holding device of FIG. 3.

Referring now to FIGS. 3-5, washer holding device 24 includes an arm 34 to which receptacle 28 is mounted at one end 36. In the illustrated embodiment, receptacle 28 has a cavity, cup, well, pocket or detent 38 for receiving a washer 26, with cavity 38 being defined by an internal circumferential wall 40 and a base surface 42. Aperture 30 is formed as a through hole on base surface 42. Receptacle 28 also includes a contacting surface 44, which as described below, contacts a building surface to which a washer 26 is to be applied.

Washer holding device 24 also includes an external shoulder, which in the illustrated embodiment is an annular flange 46 disposed about the entire circumference of receptacle body 48. As best understood from FIGS. 4 and 5, flange 46 is recessed from contact surface 44 by an offset 50 (FIG. 4), and includes a flange surface or second contacting surface 52. Cavity 38 further includes a depth 54 (FIG. 5) as measured from contact surface 44 to base surface 42. Depth 54 may be, for example, designed based on the thickness of washer 26, and in particular may be designed with consideration of the dimension of offset 50 such that, as described in detail below, washer 26 is recessed a desired amount into a building surface to which washer 26 is applied. Flange 46, as described below, operates to limit the distance that receptacle 28 will penetrate into a deformable building surface.

Arm 34 of washer holding device 24 is a straight member and includes a plurality of mounting apertures 56 used to mount device 24 to gun 22 by, for example, a threaded mounting screw (not shown). The multiple mounting apertures 56 enable the position of the receptacle 28 relative to the gun 22 to be selectively adjusted based upon which aperture 30 is used to secure arm 34 to gun 22. Receptacle 28 is mounted to end 36 of arm 34, without arm blocking aperture 30.

As noted, receptacle 28 is constructed to receive and temporarily retain a nonmagnetic washer, such as plastic washer 26. Washers may be used in securing a wide range of building materials, including soft foam, rigid foam, or hard surfaces, including securing building wrap or vapor barrier products to such surfaces. Soft foam applications include expanded poly styrene (EPS) foam, exterior insulation finish systems (EIFS), or polymer based (PB) systems. Rigid foam applications include poly-iso or extruded polymer modified (PM)

systems. Hard material applications include exterior gypsum or plywood, over which building wrap may be applied.

Typical outside diameters of plastic washers conventionally used in the industry include one and three-quarter (1¾) and two (2) inches, with the thickest portion of such washers being approximately three-sixteenths (3/16) inches. In the illustrated embodiment, washer 26 is a Plasti-Grip® brand washer having a one and three-quarter (1¾) inch outside diameter, with a curved or convex top surface 58 (FIG. 2). Washer 26 includes a central hole 60 into which a fastener 32 is driven to mount washer 26 to a building surface. Washer 26 also includes an inner-center concentric seal 62 that protects against water intrusion around the fastener 32, as well as reinforced radial ribs 64 that help create maximum bearing pressures against wind loads and material movements, yet is flexible enough to not tear building wrap materials or damage foam, It should be appreciated, however, that alternatively sized, shaped, and designed washers may be employed within the scope of the present invention. Such as, for example, washers having different outside diameters or thicknesses.

Washer 26 is retained within receptacle 28 by a friction or tolerance or interference fit between washer 26 and cavity 38. In the illustrated embodiment, inner wall 40 defines an inner diameter 66 (FIG. 4) that is slightly smaller than the outside diameter of washer 26. Washer 26 is somewhat flexible due to the plastic construction of washer 26. Thus, when washer 26 is installed to cavity 38 of receptacle 28 the outside circumference of washer 26 contacts or presses against inner wall 40 of cavity 38 sufficiently to retain washer 26 within cavity 38. Additionally, washer 26 may be installed to cavity 38 such that top surface 58 contacts base surface 42.

Figure 6:
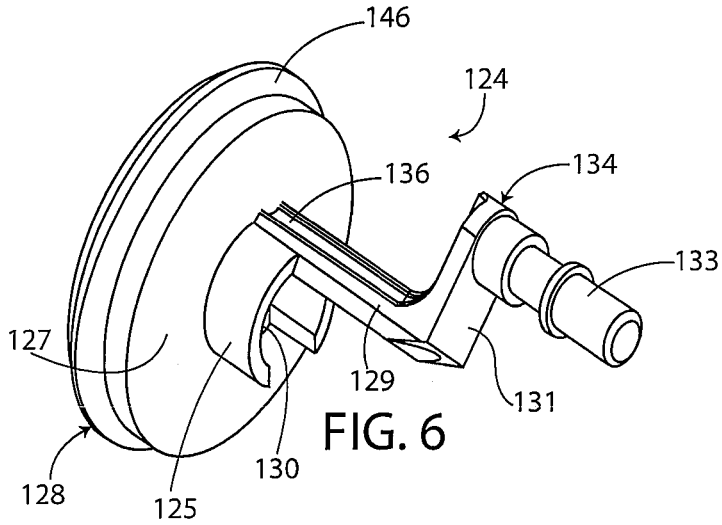
FIG. 6 is a perspective view of an alternative washer holding device in accordance with the present invention.
Figure 7:
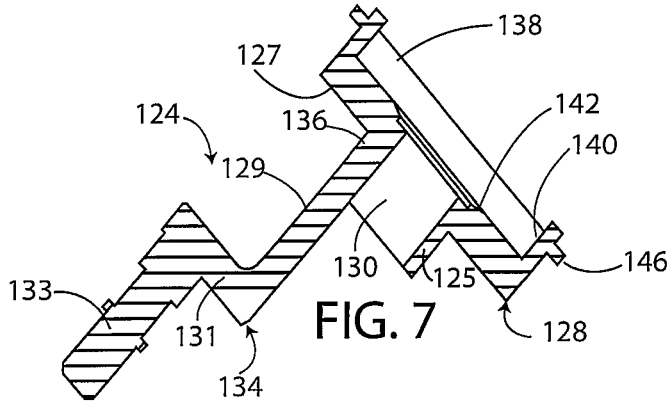
FIG. 7. is a cross-sectional view of the washer holding device of FIG. 6.

Referring now to FIGS. 6 and 7, an alternative washer holding device 124 is illustrated that is of similar construction to washer holding device 24, where the similar components or elements of washer holding device 124 are shown with similar reference numbers as used in FIGS. 3-5 with respect to washer holding device 24, but with 100 added to the reference numbers of FIGS. 3-5. Not all of the specific construction and alternatives of like referenced parts are addressed in the following discussion of washer holding device 124 due to the similarities between washer holding device 124 to device 24.

Washer holding device 124 includes a receptacle 128 having a, cavity 138 for receiving a nonmagnetic washer, with cavity 138 defined by an inner wall 140 and a base surface 142, with receptacle 128 including an aperture 130 through base surface 142. Cavity 138 is adapted to retain a nonmagnetic washer in like fashion to cavity 38, as discussed above, by a friction or tolerance or interference fit. Receptacle 128 further includes a contact surface 144 and a shoulder formed as an external annular flange 146 disposed about receptacle 128.

Receptacle 128 is affixed to an end 136 of arm 134, with end 136 of arm 134 including a C-shaped collar 125 to which an underside 127 of receptacle 128 is joined. Arm 134 includes a straight member 129 and an offset angled member 131 with a quick connect coupling 133 affixed to angled member 131 such that coupling member 133 and straight member 129 are generally parallel to one another. Arm 134 enables washer holding device 124 to be used with alternative fastener guns (not shown) as compared to fastener gun 22 of FIG. 1. In particular, coupling 133 is adapted to be received to a mating quick connect coupling on such an alternative fastener gun.

Figure 8:
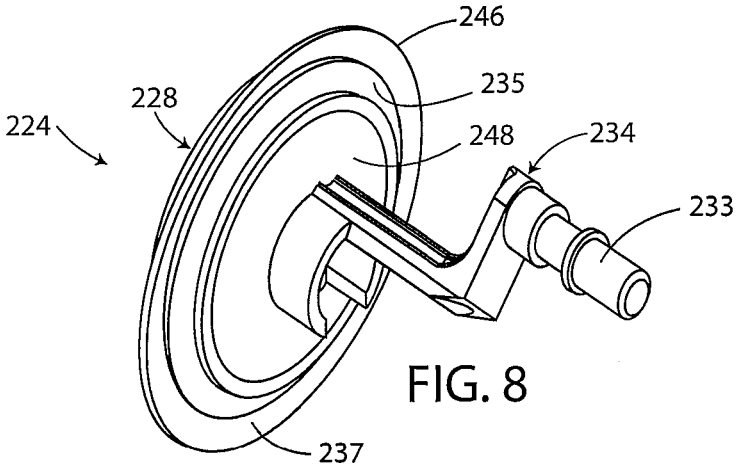
FIG. 8 is a perspective view of an alternative washer holding device in accordance with the present invention.

Referring now to FIG. 8, an alternative washer holding device 224 is illustrated that is of similar construction to washer holding device 124, where the similar components or elements of washer holding device 224 are shown with similar reference numbers as used in FIGS. 6-7 with respect to washer holding device 124, but with 100 added to the reference numbers of FIG. 8. Not all of the specific construction and alternatives of like referenced parts are addressed in the following discussion of washer holding device 224 due to the similarities between washer holding device 224 to device 124.

Washer holding device 224 includes a receptacle 228 having an alternative flange 126 that includes a step or support member 235 on the underside 237 of flange 246. In the illustrated embodiment, flange 246 extends radially outwardly from the receptacle body 248 approximately three-eights (3/8) inches. As also shown, device 224 includes an arm 234 including a quick connect coupling 233 for attachment to a fastener gun.

Figure 9:
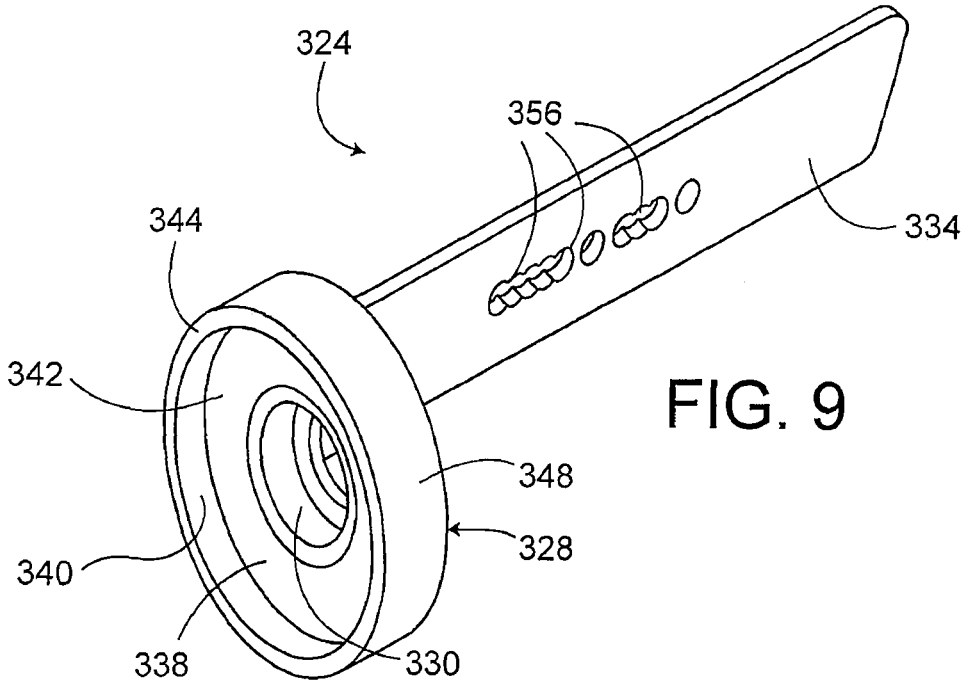
FIG. 9 is a perspective view of another washer holding device in accordance with the present invention.

Referring now to FIG. 9, still another alternative washer holding device 324 is illustrated that is of similar construction to washer holding device 24, where the similar components or elements of washer holding device 324 are shown with similar reference numbers as used in FIGS. 3-5 with respect to washer holding device 24, but with 300 added to the reference numbers of FIG. 9. Not all of the specific construction and alternatives of like referenced parts are addressed in the following discussion of washer holding device 324 due to the similarities between washer holding device 324 to device 24.

Washer holding device 324 includes a receptacle 328 mounted to an arm 334 comprising a straight member having a plurality of mounting apertures 356. Receptacle 328 comprises a body 348 having a cavity 338 defined by an inner wall 340 and a base surface 342, with an aperture 330 extending through base surface 330, and a contact surface 344. Cavity 338 is adapted to retain a nonmagnetic washer in like fashion to cavity 38, as discussed above, by a friction or tolerance or interference fit. Unlike washer holding device 24, however, washer holding device 324 does not include a shoulder or flange extending from body 348 and disposed about receptacle 328. Accordingly, although useable to apply nonmagnetic washers to all types of building surfaces, washer holding device 324 is particularly suited for use with hard building surfaces into which receptacle will not penetrate.

Figure 10:
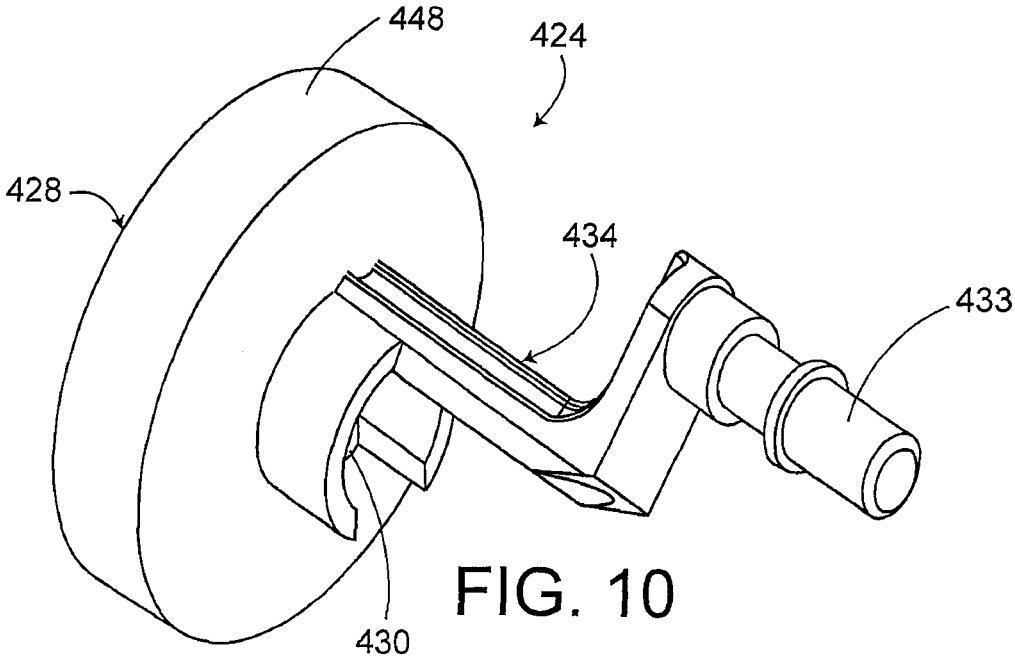
FIG. 10 is a perspective view of yet another washer holding device in accordance with the present invention.

Referring now to FIG. 10, another alternative washer holding device 424 is illustrated that is of similar construction to washer holding device 124, where the similar components or elements of washer holding device 424 are shown with similar reference numbers as used in FIGS. 6-7 with respect to washer holding device 124, but with 300 added to the reference numbers of FIG. 10. Not all of the specific construction and alternatives of like referenced parts are addressed in the following discussion of washer holding device 424 due to the similarities between washer holding device 424 to device 124.

Washer holding device 424 includes a receptacle 428 mounted to an arm 434 having a quick connect coupling 433. Receptacle 428 comprises a body 448 having a cavity (not shown) with an aperture 430 extending through body 448 and the cavity of device 424 adapted to retain a nonmagnetic washer in like fashion to cavity 38, as discussed above, by a friction or tolerance or interference fit. Unlike washer holding device 124, however, washer holding device 424 does not include a shoulder or flange extending disposed about receptacle. Accordingly, although useable to apply nonmagnetic washers to all types of building surfaces, washer holding device 424 is particularly suited for use with hard building surfaces into which receptacle will not penetrate.

The illustrated gun of FIG. 1 is electrically driven and adapted for use with an assemblage 39 of collated threaded fasteners 32. An example of which is a TYREX brand fastener gun supplied by TyRex Commercial Tools and Fasteners, LLC of Cincinnati, Ohio. Alternatively, however, pneumatic, gas, or other power driven guns may be employed. As noted, such alternative guns may employ alternative means of securing a washer holding device in accordance with the present invention thereto, such as by a quick connect coupling, to form a washer holding device and fastener gun assembly in accordance with the present invention. It should also be appreciated that still further alternative arms may be devised for different styles and/or makes of fastener guns. Likewise, alternative fasteners other than threaded fasteners may be employed, such as nails, as well as systems in which the fasteners are not collated together.

Figure 11:
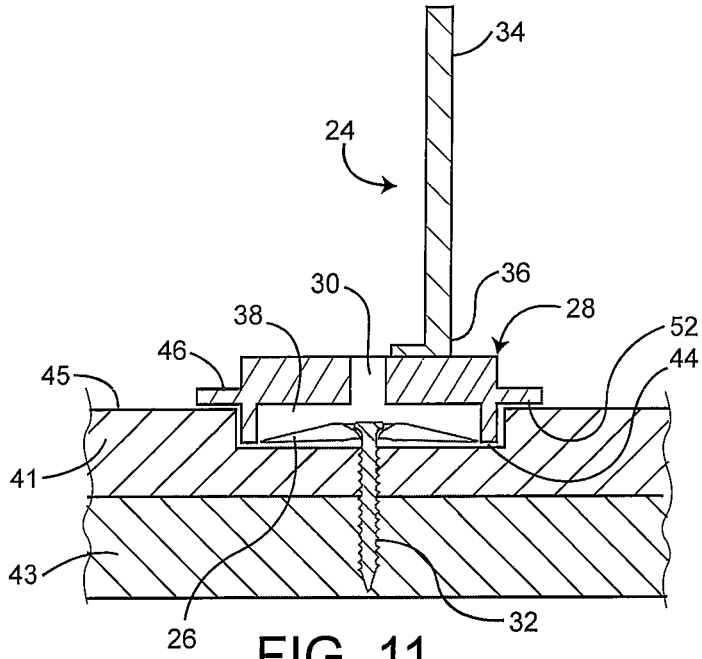
FIG. 11 is a cross-sectional view of the washer holding device of FIG. 3 disclosing the application of a washer and fastener to a deformable building material.

The installation of a washer to a building material surface by way of a washer holding device in accordance with the present invention will be discussed with reference to FIGS. 11 and 12. FIG. 11 illustrates the use of washer holding device 24 to secure washer 26 to a deformable building material 41, such as a foam material, that is being applied over a hard material 43, such as a wood board, with fastener 32 already having been driven there through. Initially, washer 26 is placed within cavity 38 of washer holding device 24 to temporarily retain washer 26 therein, with washer holding device 24 mounted to a fastener gun (not shown in FIG. 11), such as gun 22, Washer holding device 24 is then placed against the surface 45 deformable building material 41 to disarm the safety mechanism of the fastener gun and thereby allow activation of the fastener gun to drive fastener 32. Upon activation of the fastener gun, fastener 32 is driven through aperture 30 of washer holding device 24 into central hole 60 of washer 26 and into building surfaces 41 and 43.

It should be appreciated that the driving torque and insertion of fastener 32 into hard building material 43 causes the washer 26 and fastener 32 assembly to be drawn into the building materials 41, 43. Moreover, because of the deformable nature of building material 41, receptacle 28 of washer holding device 24 will likewise be drawn or forced into deformable building material 41, as shown in FIG. 11. In the case of a threaded fastener, such as shown, fastener gun will stop driving fastener upon reaching a preset depth or the resistance of fastener into building materials 41, 43 reaching a pre-set threshold limit of fastener gun whereby fastener gun is automatically deactivated.

Advantageously, flange surface 52 of flange 46 of washer holding device 24 will eventually come into contact with surface 45 of building material 41, as shown, and provides an enlarged surface area to distribute the contact force of washer holding device 24 against the surface 45 deformable building material 41 to thereby impede or inhibit or limit the depression of washer holding device 24 into deformable building material 41. This prevents damage to building material 41. Moreover, by appropriate sizing of offset 50 relative to contact surface 44 and depth 54 of cavity 38 relative to the thickness of washer 26, washer 26 can be caused to be recessed beneath the surface 45 of building material 41. This is advantageous when, for example, additional materials may be applied over building surface 45, such as a coating material, sheathing wrap, or the like. By recessing washer 26 and fastener 32 sufficiently the washer 26 is not visible or does not protrude from building surface 45, as well is not over recessed relative to building surface 45 such that excessive base coatings must be added to the depression to cover washer 26 and fastener 32, thereby saving money in both time and materials.

Figure 12:
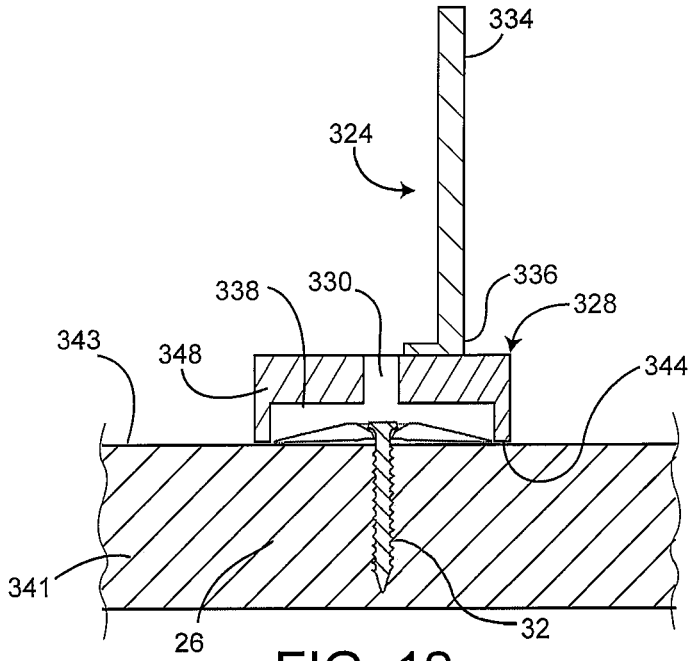
FIG. 12 is a cross-sectional view of the washer holding device of FIG. 9 disclosing the application of a washer and fastener to a hard building material.

FIG. 12 illustrates the use of washer holding device 124 to secure washer 26 directly to a hard building material 341, such as plywood. Although not shown, a building wrap material may, for example, be secured between washer 26 and the surface 343 of building material 341 whereby 26 washer aids in retaining the wrap material to building surface 343, The application of washer 26 and fastener 32 to building surface 343 by a fastener gun (not shown) is substantially similar to the application discussed above with respect to FIG. 11. However, because building material 341 is not deformable, washer holding device 124 does not depress into building material 341.

Although washer holding device 24 is discussed above in relation to a deformable building material 41 and washer holding device 124 is discussed in relation to a hard building material 341, it should be appreciated that holding device 24 may be readily used with a hard building material. Likewise, washer holding device 124 may be used with a deformable building material when the depression of receptacle into the material is of lesser concern. It should also be appreciated that alternative shoulder arrangements other than the flanges discussed above may be employed within the scope of the present invention, including shoulders that do not extend completely around a receptacle body, or a washer holding device having more than one shoulder.

The washer holding device and assembly including a fastener gun, along with the method of use, of the present invention provide an accurate, convenient and safe way to apply nonmagnetic washers to a building surface. Installers using the present invention do avoid having to place a hand in front of a fastener gun to hold a washer in place, which makes the operation safer and more efficient by freeing up a hand. Nonmagnetic washers are also precisely held in place prior to installation such that the washers are more accurately and repeatedly installed. Embodiments including a shoulder provide a washer holding device that is well suited for use with deformable building materials such as foam to limit the penetration of the washer holding device into the building material and control the depth of installation of the washer.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A washer holding device for temporarily retaining nonmagnetic washers being applied to a building material surface with a fastener gun, said washer holding device comprising:

an arm having a first end and a second end, said arm being selectively and removably affixable to a fastener gun; and a washer receptacle, said washer receptacle being joined to said first end of said arm and including a building material surface contacting end, a washer receiving cavity inwardly recessed from said contacting end, and a central aperture, with said contacting end defining a distal end of said washer holding device;

said cavity including an internal wall, said internal wall being generally perpendicularly oriented to said contacting end and sized to receive a nonmagnetic washer with said internal wall defining a diameter that is smaller than the diameter of said nonmagnetic washer such that said nonmagnetic washer is temporarily retained within said cavity via a friction fit engagement with said internal wall of said cavity, and wherein said nonmagnetic washer is recessed beneath said contacting end when retained within said cavity with said central aperture enabling a fastener to be driven from a fastener gun through said central aperture and through said nonmagnetic washer to affix said nonmagnetic washer to a building material surface;

wherein said washer receptacle is disposed within a receptacle body, said receptacle body including a radially outwardly extending external shoulder defining a contacting surface with said contacting surface being recessed away from said contacting end of said washer holding device, said contacting surface of said shoulder contacting a building material surface and limiting the depression of said washer receptacle into the building material surface when said washer holding device is used to apply a nonmagnetic washer to a deformable building material and said contacting end depresses into the deformable building material surface.

2. The washer holding device of claim 1, wherein said shoulder comprises a flange at least partially surrounding said washer receptacle.

3. The washer holding device of claim 2, wherein said flange comprises an annular flange disposed about said washer receptacle.

4. The washer holding device of claim 1, wherein said shoulder is recessed from said contacting end a distance at least as thick as said nonmagnetic washer.

5. The washer holding device of claim 1, wherein said internal wall is a continuous circumferential wall.

6. The washer holding device of claim 1, wherein said cavity further includes an internal base surface, and wherein said central aperture is formed through said base surface.

7. The washer holding device of claim 1, wherein said arm is at least one of straight or angled, and includes at least one of a mounting aperture and a quick connect coupling.

8. A washer holding device and fastener gun assembly for applying nonmagnetic washers to a building material surface using fasteners, said assembly comprising:

a fastener gun, said fastener gun adapted for driving fasteners;

a washer holding device for temporarily retaining a nonmagnetic washer that is to be applied to a building material surface, said washer holding device comprising:

an arm having a first end and a second end, said arm including at least one of a mounting aperture and a quick connect coupling for selectively and removably affixing said arm to said fastener gun; and a washer receptacle, said washer receptacle being mounted to said first end of said arm and including a building material surface contacting end, a washer receiving cavity inwardly recessed from said contacting end, and a central aperture, with said contacting end defining a distal end of said washer holding device;

said cavity including an internal wall sized to receive a nonmagnetic washer with said internal wall defining a diameter that is smaller than the diameter of said nonmagnetic washer such that said nonmagnetic washer is temporarily retained within said cavity via a friction fit engagement with said internal wall of said cavity with said nonmagnetic washer being recessed beneath said contacting end when retained within said cavity;

said fastener gun being activated to enable a fastener to be applied by said fastener gun when said contacting end of said washer holding device is depressed against a building material surface with a fastener being driven through said central aperture and through said nonmagnetic washer to secure said nonmagnetic washer to a building material surface;

wherein said washer receptacle is disposed within a receptacle body, said receptacle body including a radially outwardly extending flange at least partially surrounding said washer receptacle, said flange defining a contacting surface recessed away from said contacting end of said washer holding device, said flange contacting a building material surface and limiting the depression of said washer receptacle into the building material surface when said washer holding device is used to apply a nonmagnetic washer to a deformable building material and said contacting end depresses into the deformable building material surface.

9. The assembly of claim 8, wherein said flange comprises an annular flange disposed about said receptacle body, said flange extending generally perpendicularly outwards from said receptacle body relative to the axis of application of a fastener through said central aperture.

10. The assembly of claim 8, wherein said flange is recessed from said contacting end a distance at least as thick as said nonmagnetic washer.

11. The assembly of claim 8, wherein said internal wall is a continuous circumferential wall.

12. A washer holding device for temporarily retaining nonmagnetic washers being applied to a building material surface with a fastener gun, said washer holding device comprising:

an arm having a first end and a second end, said arm being selectively and removably affixable to a fastener gun; and a washer receptacle, said washer receptacle being joined to said first end of said arm and including a building material surface contacting end, a washer receiving cavity inwardly recessed from said contacting end, and a central aperture, with said contacting end defining a distal end of said washer holding device;

said cavity being cup shaped with said cavity being defined by an internal wall and an internal base surface, wherein said internal wall defines a sidewall of said cavity that is sized to receive a nonmagnetic washer with said internal wall defining an internal diameter that is smaller than the diameter of said nonmagnetic washer such that the nonmagnetic washer is temporarily retained within said cavity via a friction fit engagement with said internal wall of said cavity, and wherein said nonmagnetic washer is recessed beneath said contacting end when retained within said cavity with said central aperture enabling a fastener to be driven from a fastener gun through said central aperture and through the nonmagnetic washer to affix the nonmagnetic washer to a building material surface;

wherein said washer receptacle is disposed within a receptacle body, said receptacle body including a radially outwardly extending external shoulder defining a contacting surface with said contacting surface being recessed away from said contacting end of said washer holding device, said contacting surface of said shoulder contacting a building material surface and limiting the depression of said washer receptacle into the building material surface when said washer holding device is used to apply a nonmagnetic washer to a deformable building material and said contacting end depresses into the deformable building material surface.

13. The washer holding device of claim 12, wherein said shoulder comprises a flange at least partially surrounding said washer receptacle.

14. The washer holding device of claim 13, wherein said flange comprises an annular flange disposed about said washer receptacle.

15. The washer holding device of claim 12, wherein said internal wall is a continuous circumferential wall.

16. The washer holding device of claim 12, wherein said arm is at least one of straight or angled, and includes at least one of a mounting aperture and a quick connect coupling.

17. The washer holding device of claim 1, wherein said nonmagnetic washer is generally disk shaped.

* * * * *

UNITED STATES PATENT AND TRADEMARK OFFICE

CERTIFICATE OF CORRECTION

PATENT NO. : 8,413,740 B2
APPLICATION NO. : 12/507851
DATED : April 9, 2013
INVENTOR(S) : Robert H. Rodenhouse It is certified that error appears in the above-identified patent and that said Letters Patent is hereby corrected as shown below:

In the Specification

Column 2
Line 2, "ann" should be --arm--

Signed and Sealed this
Twelfth Day of November, 2013

Teresa Stanek Rea
*Deputy Director of the United States Patent and Trademark Office*